US008602759B2

(12) United States Patent
Birch et al.

(10) Patent No.: US 8,602,759 B2
(45) Date of Patent: Dec. 10, 2013

(54) SCREW-TYPE VACUUM PUMP HAVING OVERPRESSURE OPENINGS

(75) Inventors: Peter Birch, Sussex (GB); Robert Jenkins, Sussex (GB); Roland Müller, Köln (DE); Magnus Janicki, Köln (DE); Wolfgang Giebmanns, Erftstadt (DE)

(73) Assignee: Oerlikon Leybold Vaccum GmbH, Cologne (DE)

( * ) Notice: Subject to any disclaimer, the term of this patent is extended or adjusted under 35 U.S.C. 154(b) by 99 days.

(21) Appl. No.: 13/264,021

(22) PCT Filed: Apr. 13, 2010

(86) PCT No.: PCT/EP2010/054842

§ 371 (c)(1),
(2), (4) Date: Nov. 1, 2011

(87) PCT Pub. No.: WO2010/119038

PCT Pub. Date: Oct. 21, 2010

(65) Prior Publication Data

US 2012/0039737 A1 Feb. 16, 2012

(30) Foreign Application Priority Data

Apr. 17, 2009 (DE) ..... 10 2009 017 886

(51) Int. Cl.
*F01C 1/24* (2006.01)
*F03C 2/00* (2006.01)
*F03C 4/00* (2006.01)

(52) U.S. Cl.
USPC ..... 418/201.2; 418/201.1; 418/270

(58) Field of Classification Search
USPC ..... 418/201.1–201.2, 270
See application file for complete search history.

(56) References Cited

U.S. PATENT DOCUMENTS

| | | | | |
|---|---|---|---|---|
| 1,737,588 | A * | 12/1929 | Hopkins et al. | 137/523 |
| 2,519,913 | A * | 8/1950 | Lysholm | 418/201.2 |
| 3,677,664 | A | 7/1972 | Wycliffe et al. | |
| 6,497,563 | B1 * | 12/2002 | Steffens | 418/201.1 |

FOREIGN PATENT DOCUMENTS

| | | |
|---|---|---|
| DE | 100 45 768 C1 | 3/2002 |
| JP | 3111690 | 5/1991 |
| WO | WO 2006/099104 | 9/2006 |

OTHER PUBLICATIONS

International Search Report for PCT/EP2010/054842 dated Apr. 28, 2010.

English Translation of International Preliminary Report on Patentability Chapter I (IB/373) in corresponding International Application No. PCT/EP2010/054842 dated Oct. 18, 2011.

English Translation of the Written Opinion of the International Search Authority in corresponding International Application No. PCT/EP2010/054842 dated Oct. 18, 2011.

* cited by examiner

*Primary Examiner* — Theresa Trieu
(74) *Attorney, Agent, or Firm* — Ohlandt, Greeley, Ruggiero & Perle, LLP

(57) ABSTRACT

A screw vacuum pump, in particular for compression against atmospheric pressure, comprises a pump housing defining a suction chamber. Two meshing screw rotors are arranged in the suction chamber. Further, an overpressure outlet provided, which comprises an overpressure opening in a side wall of the suction chamber. Further, an overpressure valve is arranged in the overpressure outlet. The width (b) of the overpressure opening in the longitudinal direction of the screw rotors is smaller than or equal to a tooth width (B) of the screw rotors.

14 Claims, 2 Drawing Sheets

SCREW-TYPE VACUUM PUMP HAVING OVERPRESSURE OPENINGS

BACKGROUND

1. Field of the Invention

The disclosure refers to a screw vacuum pump, preferably for the compression of a medium, typically gas, with respect to atmosphere.

2. Discussion of the Background Art

Screw vacuum pumps have a suction chamber in a pump housing. Two screw rotors are arranged in the suction chamber. On their outer side, the screw rotors each have a helical thread, with the two threads of the screw rotors meshing in order to convey and compress the medium. Within the suction chamber, the medium conveyed is compressed from the suction side, i.e. the pump inlet, towards the pressure side, i.e. the pump outlet. Typical compression ratios of screw vacuum pumps are in the range from 1 to $10^6$. Depending on the pressure present at the pump inlet, an over-compression can be caused in the screw vacuum pump. Such an over-compression, i.e., in the case of a pumping against atmosphere, a pressure above atmospheric pressure, results in a strong increase in the energy consumption of the screw vacuum pump. This leads to power losses, since an unnecessary compression, i.e. an over-compression, of the medium to be transported is performed.

In the interest of avoiding over-compression in screw vacuum pumps, it is known from DE 100 45 768, for instance, to provide an overpressure outlet. The overpressure outlet has a overpressure opening in a side wall of the suction chamber. An overpressure valve is arranged in the overpressure outlet.

It is an object of the present disclosure to design the overpressure outlet such that the risk of an overpressure occurring in the screw vacuum pump is reduced and the pumping performance as well as the energy efficiency of the screw vacuum pump is improved.

SUMMARY

According to the disclosure a plurality of overpressure openings are provided which are preferably arranged on the same pressure level. By providing a plurality of overpressure openings, the effective cross section of the entire overpressure opening can be increased in a simple manner in order to guarantee for a fast medium removal.

According to a first embodiment, it is preferred to arrange a plurality of overpressure openings on the same pressure level. Such overpressure openings are thus arranged on a line corresponding to the path of the screw rotor's pitch. Further, it is also possible to arrange a plurality of overpressure openings, possibly designed as elongate holes, on different pressure levels, with such overpressure openings being spaced apart from each other in the longitudinal direction of the screw rotor. The arrangement of a plurality of overpressure openings on the same pressure level and the arrangement of a plurality of overpressure openings on different pressure levels can of course be combined.

If a plurality of overpressure openings is provided, these are preferably at least partially connected with the same overpressure outlet. This simplifies the structure of the vacuum pump, specifically of the vacuum pump housing.

Preferably, the at least one overpressure outlet comprises one channel that is connected with the pump outlet of the screw vacuum pump, with atmospheric pressure preferably being present at the pump outlet. The channel preferably extends in the longitudinal direction of the screw rotors. A plurality of overpressure openings can open into such a channel extending in the longitudinal direction of the screw rotors, which openings would then be arranged on different pressure levels. The overpressure openings may possibly be connected with the channel through transverse bores. Further, it is possible to provide a plurality of preferably longitudinally extending channels in the pump housing, wherein a plurality of overpressure openings are connected with the individual channels, which openings may then be situated at least partially on the same pressure level. Again, the provision of at least one channel represents an independent disclosure that is independent of the width of the overpressure openings, but is preferably combined with this disclosure.

In another preferred embodiment of the above disclosures, a plurality of overpressure openings are connected with a common overpressure valve, in particular via individual feed channels. Thereby, when the effective cross section of the overpressure openings is enlarged, a simple economic structure can still be realized, since it is not necessary to provide a separate overpressure valve for each overpressure opening.

The overpressure valves of choice comprise valve bodies with a convex outer side. Specifically, the valve bodies are balls. Using such valve bodies is advantageous in that they can move, especially rotate, in the valve seat when the valve is operated, thereby effecting an automatic cleaning of the valve seat and the ball. The valve seat itself is shaped correspondingly complementary to the outer side of the valve body abutting against the valve seat. In particular, it is a frustoconical bore.

In order to set the pressure at which the overpressure valve opens, it is possible to provide a spring-loaded valve body. For a simplification of the structure, it is preferred to provide weight-loaded valves. Preferably, such valves are arranged within the pump housing such that the valve bodies contact the valve seats due to their weight.

Suitable materials for the valve body and the valve seat are, in particular, material pairings of elastomer and metal. For instance, an elastomer ball may be arranged in a valve seat made from a metallic material, or a metal ball may be arranged in a valve seat made from an elastomer material. It is further possible to provide elastomer-coated metal balls which would be arranged in a metal valve seat. Moreover, combinations of hard and soft metal materials or ceramic materials are possible. A suitably selected material pairing can guarantee a good sealing in the closed state of the overpressure valve. Further, the selection of a material is done on the basis of the process medium to convey and of the temperatures prevailing as well as the required weight for weight-loaded valves.

In typical screw vacuum pumps with a suction capacity from 50 to 1000 $m^3/h$, balls with a diameter ranging between 20 and 30 mm are used as the valve bodies. In this instance, the bore of the valve seat has a diameter between 16 and 20 mm.

In another preferred embodiment, the channel of the overpressure outlet is closed with a housing cover. Possibly, a plurality of channels provided, which are specifically integrated in the pump housing, can be closed with a common cover. Here, the housing cover is preferably designed such that it extends over the entire length of the channel so that the housing cover forms or closes a longitudinal side of the channel. Thereby, it is becomes possible in a simple manner to clean and maintain the channel or channels of the overpressure outlet as well as the valves preferably arranged therein. Further, when assembling the screw vacuum pump, it is readily possible, with the housing cover removed, to provide the corresponding valve bores at the position desired for the corresponding pump, since the channel is open to one side and is thus well accessible. Further, mounting the holding elements for the valve bodies and mounting the other components in the valve is thus facilitated.

It is further preferred to arrange the at least one channel of the overpressure outlet in such a manner in the pump housing that the same is well accessible even if the pump housing is connected with an extension part, such as another pump.

In another preferred embodiment, the at least one channel of the overpressure outlet extends over the entire length of the screw vacuum pump, i.e. from the pump inlet to the pimp outlet. Here, an overpressure valve is also provided in the inlet region. This is advantageous in that, if the desired pressure already prevails at the pump inlet, the medium can be carried off immediately through the channel, whereby unnecessary power consumption of the screw vacuum pump is avoided. If, for instance, the medium is pumped against atmosphere by two series-connected pumps and atmospheric pressure already prevails at the inlet of the second pump, the corresponding overpressure valve opens, so that, at the pump inlet of the second pump, the medium flows at least partially directly into the channel of the overpressure outlet.

It is particularly preferred, especially if a plurality of overpressure openings and, possibly, a plurality of overpressure valves are provided, to arrange a plurality of valve bodies substantially within a common channel. Here, it is preferred to form the valve seat in a channel wall.

For a positional definition of the valve bodies it is advantageous, specifically for weight-loaded valve bodies, to provide holding elements which in a particularly preferred embodiment are arranged within the channel. In this context, it is preferred to provide pin-shaped holders, wherein a spherical valve body is held by preferably three or four correspondingly arranged pins. This has the particular advantage that the holder for the valve body can be designed in a simple manner. For instance, it is possible to provide the same housing with one or a plurality of longitudinally extending channels for different types of pumps and different applications. The position of the overpressure openings is then defined by subsequently forming corresponding bores. Likewise, the holding elements can also be set into the channel in a simple manner. It is thus possible to provide one pump housing for different types of pumps or different applications, in which the desired positions of the overpressure openings and the valves can be realized in a simple manner.

In another preferred embodiment of the disclosure, the width of the overpressure opening, seen in the longitudinal direction of the screw vacuum pump or in the conveying direction, is chosen such that it is smaller than or equal to the tooth width of the screw rotor. Preferably, this takes the position of the overpressure opening into account, since the tooth width of the screw vacuum rotor may vary in the longitudinal direction. The reduction of the maximum width of the overpressure opening in the longitudinal direction, as provided by the disclosure, reduces an overflowing over the tooth of the screw rotor in the area of the overpressure opening. Thus, the occurrence of return flows, i.e. the occurrence of flows against the conveying direction, is reduced so that the pumping performance is not or only slightly reduced by providing an overpressure opening. This is particularly relevant in the mode of operation in which the overpressure valve is closed and the maximum pumping performance of the screw vacuum pump is to be achieved. Here, the width of the overpressure opening in the longitudinal direction of the screw rotor is preferably smaller than or equal to 90%, in particular smaller than or equal to 80% of the tooth width in this area.

In order to guarantee a fast medium removal in the event of an over-compression, despite a rather small width of the overpressure opening relative to the tooth width, the overpressure opening may be formed as an elongate hole with an oval or rectangular cross section, for instance. Here, the elongate hole is arranged such that the longitudinal dimension of the elongate hole corresponds to the path of the pitch of the screw rotor. Further, it is possible to provide a plurality of overpressure openings, possibly also designed as elongate holes, in order to enlarge the effective cross section of the overpressure opening for a fast medium removal.

BRIEF DESCRIPTION OF THE DRAWINGS

The following is a detailed description of the disclosure with reference to preferred embodiments and to the accompanying drawings.

In the Figures.

DETAILED DESCRIPTION OF THE PREFERRED EMBODIMENT

Figure 1:
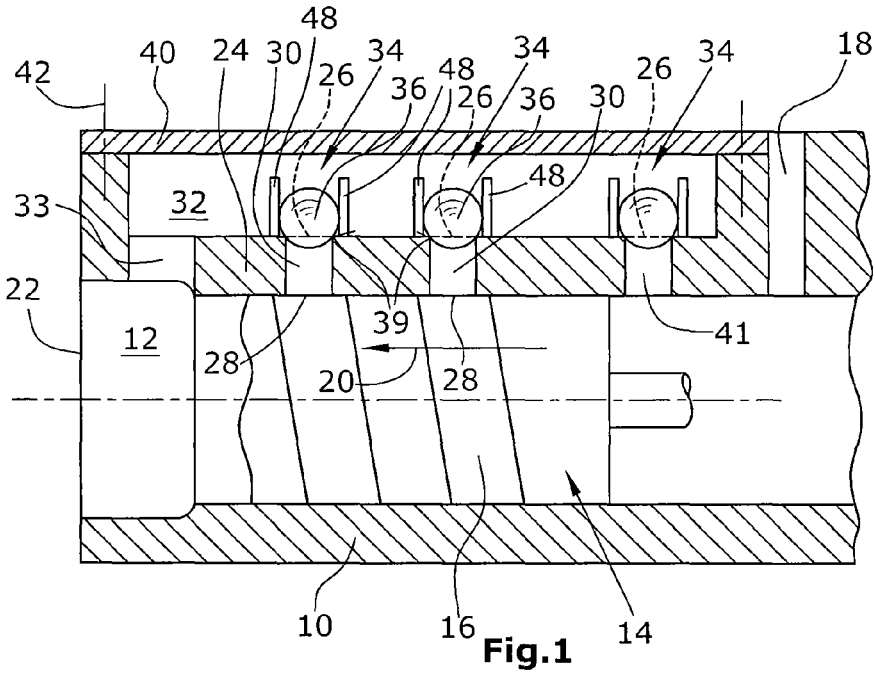
FIG. 1 is a schematic longitudinal section through a screw vacuum pump of a first embodiment.

According to a first embodiment (FIG. 1), a suction chamber is formed in a pump housing 10. Two screw rotors 14 are arranged therein one behind the other with respect to FIG. 1. The screw rotors each are provided with threads 16 on their outer sides so that the rotation of the two screw rotors 14 in opposite directions draws a medium through an inlet 18 and conveys the medium in the direction of the arrow 20 towards an outlet 22.

In the interest of avoiding over-compression within the suction chamber, a side wall 24 of the pump housing 10 is provided with an overpressure outlet 26. In the embodiment illustrated, the overpressure outlet 26 has two overpressure openings 28 communicated with the suction chamber 12. Connecting channels 30 connect the overpressure openings 28 are connected with a channel 32 extending in the longitudinal direction. The connecting channels 30 are closed with weight-loaded overpressure valves 34, wherein each overpressure valve comprises a valve body 36 in the form of a sphere. In the embodiment illustrated, the two valve bodies each contact a valve seat 39. Depending on the design of the overpressure valve 34, i.e. in particular the weight of the spherical valve body 36, the valve body 36 is pushed upward when a threshold pressure is exceeded in the connecting channel 30, so that medium flows into the channel 32.

In the embodiment illustrated, the channel 32 of the overpressure outlet 26 is connected with the pump outlet 22 via the channel 33. Preferably, atmospheric pressure prevails at the pump outlet 22.

The width b (FIG. 3) of the overpressure openings 28 in the flow direction 20 is smaller than the tooth width B of a corresponding region of the helical tooth 38 of the screw rotor 14.

Another connecting channel 41 is connected to the suction chamber 12 in the area of the pump inlet 18. This channel is also closed with a overpressure valve 34. It is the purpose of the valve 34 closing the connecting channel 41 to make the desired final pressure, typically atmospheric pressure, already prevail at the inlet 18 in special modes of operation, if possible. In such a node of operation, the medium would unnecessarily be compressed further by the screw vacuum pump. With the overpressure valve 34 provided—according to the disclosure—in the region of the pump inlet, the already sufficiently compressed medium can flow immediately into the channel 32 of the overpressure outlet and escape therefrom through the outlet 22 of the pump.

The channel 32 of the overpressure outlet 26 is closed with a housing cover 40 which is fastened to the housing 10 by means of screws 42, for instance. This allows for a simple cleaning of the channel 32 and the valves 34 by removing the housing cover 40.

Figure 2:
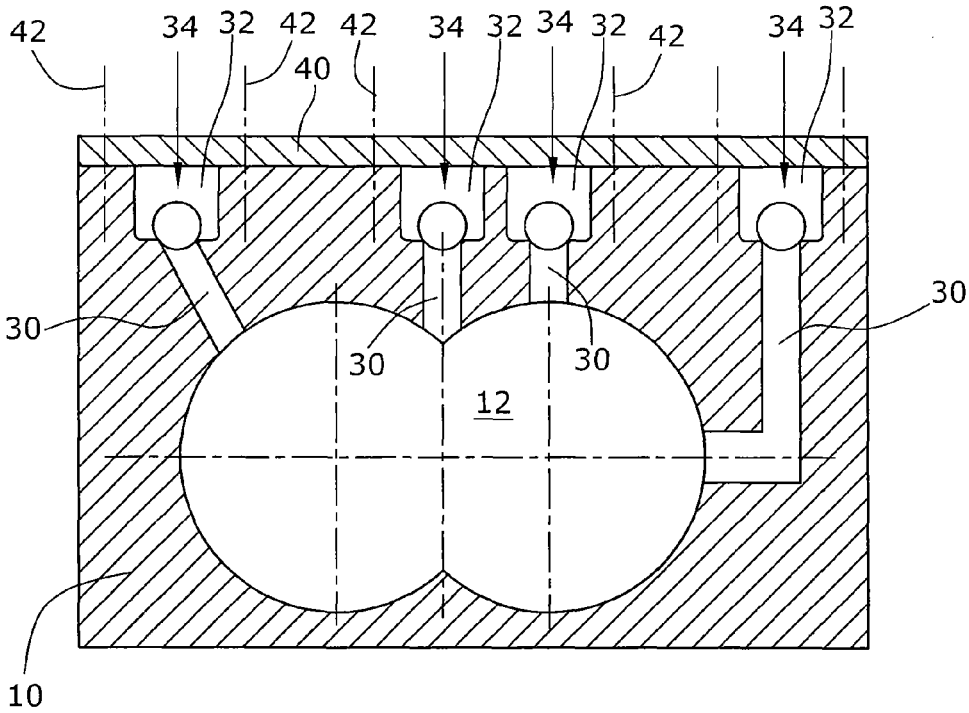
FIG. 2 is a schematic transverse section through a screw vacuum pump of another preferred embodiment.

In a further preferred embodiment of the disclosure (FIG. 2) identical or similar components are identified by the same reference numerals as above. In the embodiment illustrated in FIG. 2, the two screw rotors 14 are not illustrated in the suction chamber for reasons of clarity. A plurality of connecting channels 30 are connected with the suction chamber 12. These in turn lead to channels 32 in which overpressure valves 34 are arranged, respectively. Similar to the first embodiment (FIG. 1), the second embodiment illustrated in FIG. 2 is also provided with a housing cover 40. In this embodiment, all channels 32 illustrated are closed with a common housing cover 40.

Figure 3:
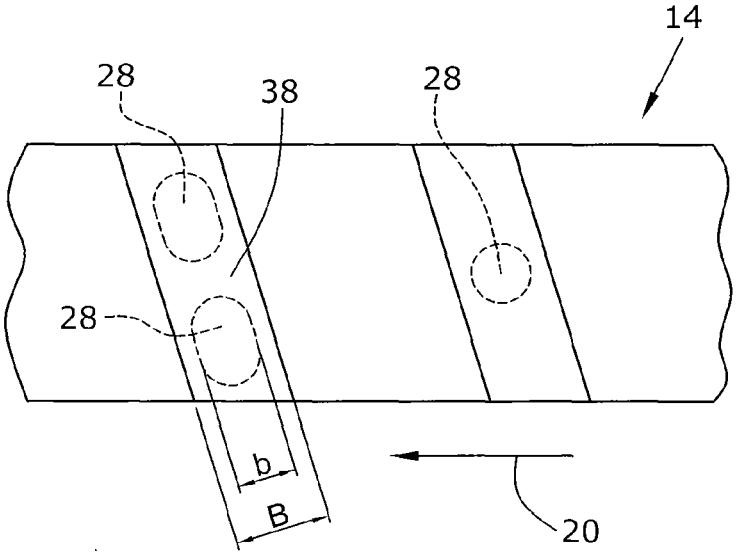
FIG. 3 is a schematic top plan view on a screw rotor with a plurality of overpressure openings indicated therein.

The overpressure openings 28 may be arranged as illustrated in FIG. 3. In this case, the two overpressure openings 28 on the left in FIG. 3 are located on one pressure level. Thus, both overpressure openings are within a region defined by a thread portion or a tooth 38. Housing openings 28 arranged one behind the other in the longitudinal direction 20 are situated on different pressure levels.

Figure 4:
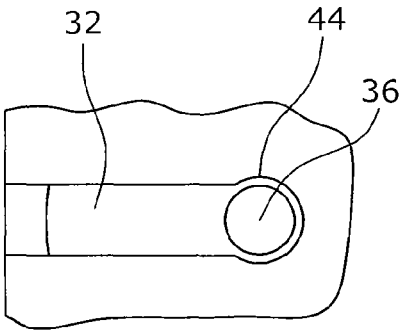
FIGS. 4, 5 are schematic illustrations of possible embodiments of overpressure outlet channels with overpressure valves arranged therein.

Holding elements are provided to hold the valve bodies 36 shaped as spheres in the embodiments illustrated. In a first embodiment (FIG. 4) this may be realized by giving the channel 32 a bulge 44 of substantially round cross section. However, this embodiment is disadvantageous in that the position of the valve 34 is predefined and the blow-off cross section can be restricted.

Figure 5:
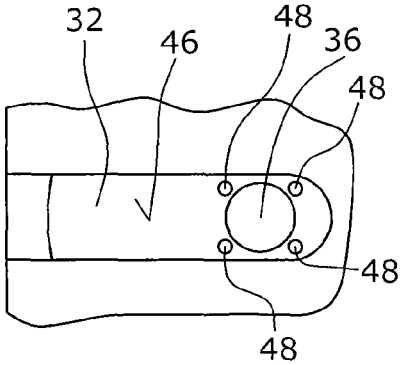

In order to be able to vary the valve openings and to also offer large flow sections, it is preferred if the channels 32 have substantially the same width over their length. The holding elements for the valve bodies 36 could then take the shape of pin-shaped holding elements 48 (FIG. 5) fastened in the channel wall 46 which are arranged in particular perpendicular to the same.

Figure 6:
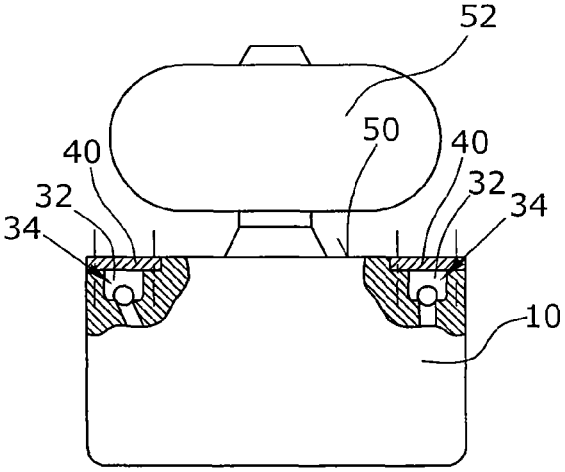
FIG. 6 is a schematic side view of a screw vacuum pump according to the disclosure connected with a Roots pump.

When two vacuum pumps are connected, as illustrated in FIG. 6, for instance, it is possible to arrange another vacuum pump 52, such as a Roots pump, on the outer top 50 of the housing 10 of the screw vacuum pump. Here, it is preferred to arrange the channels 32 of the overpressure outlets such that these are situated laterally beside the contact surface of the Roots pump 52 on the outer side 50. In the embodiment illustrated, the channels 32 are again closed with housing covers 40. Due to the preferred arrangement of the channels and of the housing covers 40, as illustrated in FIG. 6, it becomes possible to remove the housing covers 40 without having to remove the Roots pump 52. Thus, cleaning the channels 32, as well as cleaning and maintaining the overpressure valves 34 is facilitated.

What is claimed is:

1. A screw vacuum pump for compression against atmospheric pressure, comprising:

a pump housing defining a suction chamber, two meshing screw rotors arranged in the suction chamber, at least one overpressure opening arranged in a side wall of the suction chamber and connected with an overpressure outlet, the overpressure outlet comprising a channel connected with a pump outlet, an overpressure valve arranged in the overpressure outlet, and a housing cover that completely covers the channel of the overpressure outlet and the overpressure valve, wherein the at least one overpressure opening comprises a plurality of overpressure openings arranged on a common pressure level.

2. The screw vacuum pump of claim 1, further comprising a second plurality of overpressure openings arranged on different pressure levels.

3. The screw vacuum pump of claim 1, wherein the overpressure openings are at least partially connected with the overpressure outlet.

4. The screw vacuum pump of claim 1, wherein said channel extends in a longitudinal direction of the screw rotors.

5. The screw vacuum pump of claim 1, wherein the plurality of overpressure openings are connected with the overpressure valve.

6. The screw vacuum pump of claim 1, further comprising a valve body arranged within the channel, and a valve seat being arranged in a channel wall.

7. The screw vacuum pump of claim 1, further comprising a valve body which is held in the channel by pin-shaped holding elements.

8. The screw vacuum pump of claim 1, wherein the channel is integrated in the housing cover.

9. The screw vacuum pump of claim 1, wherein the channel extends in a longitudinal direction of the screw rotors from a pump inlet to a pump outlet.

10. The screw vacuum pump of claim 1, wherein the overpressure opening has a width in a longitudinal direction of the screw rotors that is smaller than or equal to a tooth width of the screw rotors.

11. The screw vacuum pump of claim 10, wherein the width is smaller than or equal to 90% of the tooth width.

12. The screw vacuum pump of claim 1, wherein the overpressure valve comprises a valve body with a convex outer side.

13. The screw vacuum pump of claim 1, wherein the overpressure valve is configured as a weight-loaded valve.

14. The screw vacuum pump of claim 10, wherein the width is smaller than or equal to 80% of the tooth width.

* * * * *